US008579248B2

(12) United States Patent
Ray

(10) Patent No.: US 8,579,248 B2
(45) Date of Patent: Nov. 12, 2013

(54) CONCRETE FORM SYSTEM AND METHOD

(76) Inventor: James Edward Ray, Hopkins, SC (US)

( * ) Notice: Subject to any disclaimer, the term of this patent is extended or adjusted under 35 U.S.C. 154(b) by 0 days.

(21) Appl. No.: 13/611,921

(22) Filed: Sep. 12, 2012

(65) Prior Publication Data

US 2013/0001831 A1 Jan. 3, 2013

Related U.S. Application Data

(63) Continuation-in-part of application No. 12/781,024, filed on May 17, 2010, now abandoned.

(51) Int. Cl.
*E04G 11/06* (2006.01)
*B65D 85/00* (2006.01)
*B65D 85/84* (2006.01)

(52) U.S. Cl.
USPC ..... 249/13; 249/1; 249/61; 249/63; 249/142; 206/0.5; 206/524.1; 206/524.6

(58) Field of Classification Search
USPC ..... 206/0.5, 524.1, 524.6; 249/1, 13, 61, 249/63, 142
See application file for complete search history.

(56) References Cited

U.S. PATENT DOCUMENTS

| | | | | |
|---|---|---|---|---|
| 3,683,760 | A * | 8/1972 | Silva | 404/72 |
| 3,748,775 | A * | 7/1973 | Wagner | 43/43.13 |
| 3,805,535 | A * | 4/1974 | Van Weele | 405/237 |
| 3,922,832 | A * | 12/1975 | Dicker | 52/741.15 |
| 4,650,368 | A * | 3/1987 | Bayer | 405/111 |
| 4,730,805 | A * | 3/1988 | Yokota et al. | 249/113 |
| 4,839,115 | A * | 6/1989 | Babcock et al. | 264/42 |
| 6,364,519 | B1 * | 4/2002 | Hughes et al. | 366/130 |

* cited by examiner

*Primary Examiner* — Milton I Cano
*Assistant Examiner* — Jeremiah Smith

(57) ABSTRACT

A concrete structure kit comprising a dry powdered concrete mixture contained within a shaped container or packaging is provided. In use, the packaged dry concrete mixture is placed in a desired location, water is added to the dry mixture in an appropriate amount, and the concrete is allowed to set in the shape of the container. After the concrete has hardened, the container may be removed from the outside of the concrete structure and discarded. In a second embodiment, a modular concrete mold system is provided, which includes a series of interlocking pieces having various shapes, such as straight sides, curved sides, corners, acute and obtuse angles, and the like. This arrangement allows a user to form a concrete mold into a variety of different shapes, as desired.

4 Claims, 2 Drawing Sheets

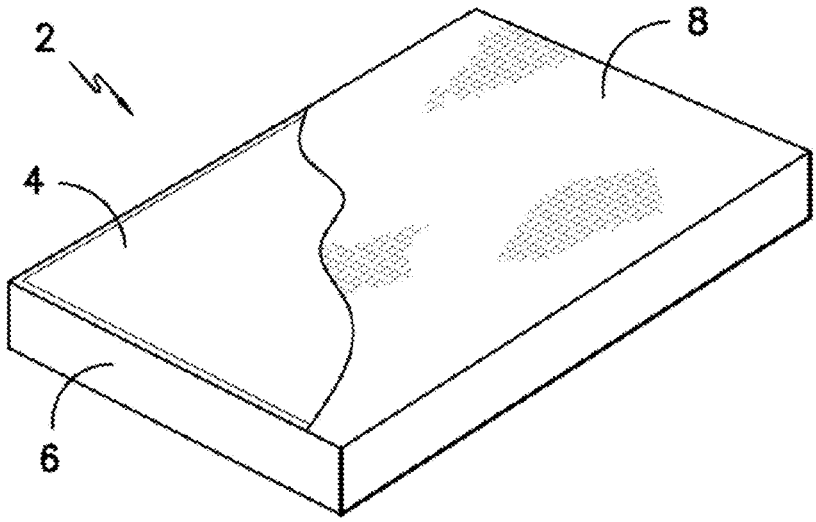
FIG. –1–
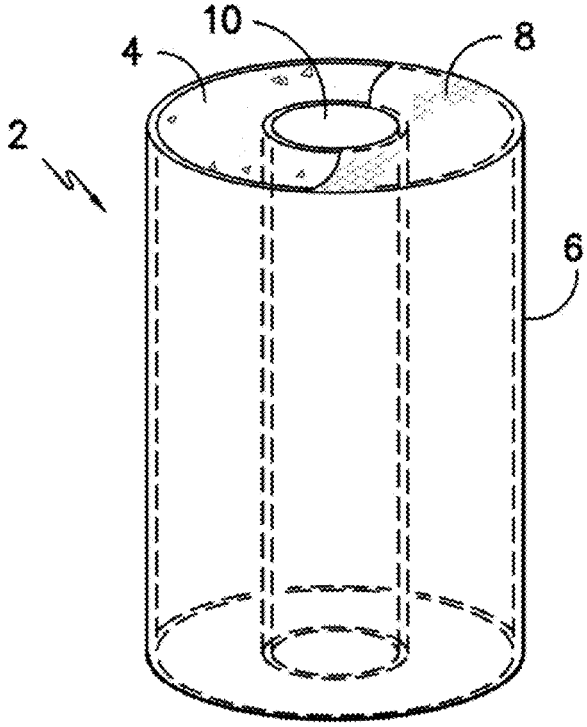
FIG. –2–

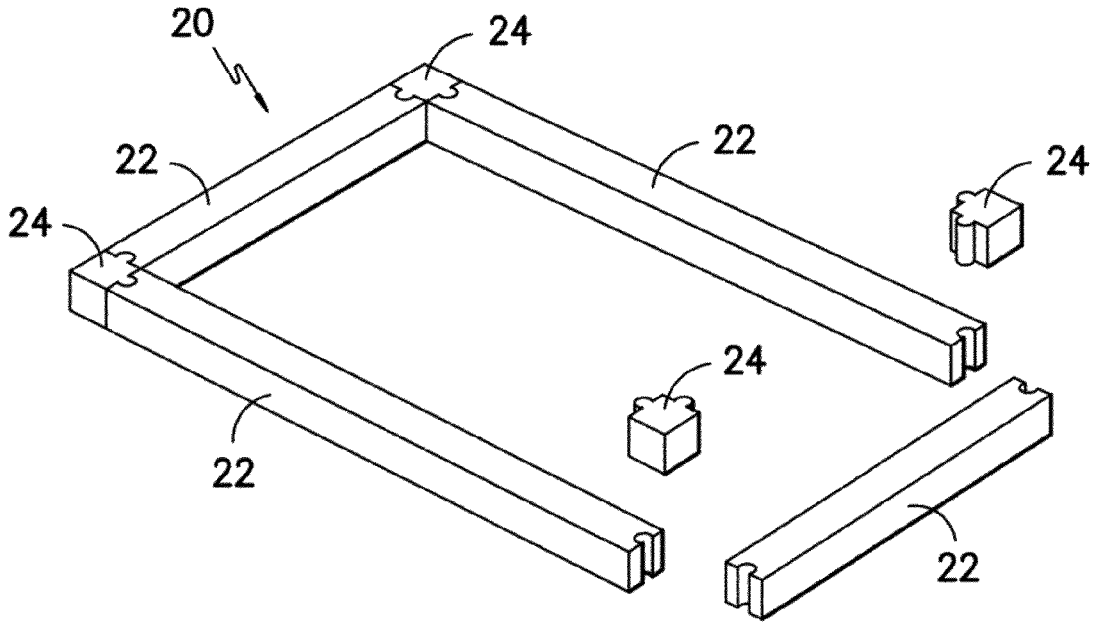
FIG. –3–
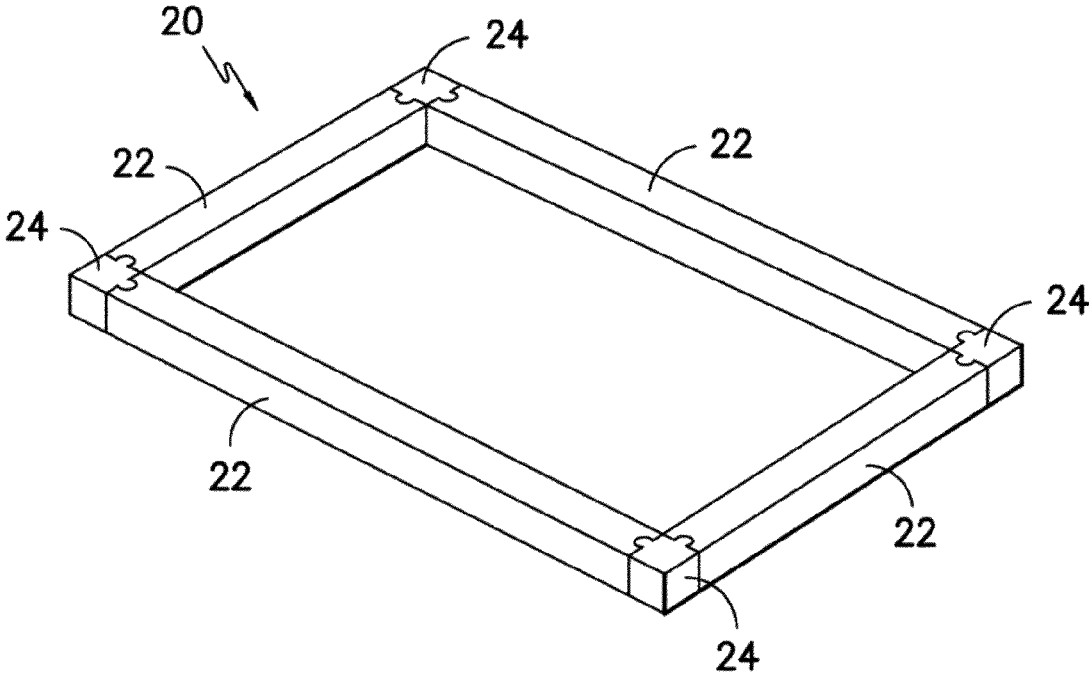
FIG. –4–

CONCRETE FORM SYSTEM AND METHOD

RELATED APPLICATIONS

This patent application is a continuation-in-part of U.S. Application No. 12/781,024 (now abandoned), filed on May 17, 2010.

BACKGROUND OF THE INVENTION

The present invention relates generally to methods and systems utilized for forming shaped concrete structures. More specifically, the present invention relates to a method and system whereby a dry concrete powder mixture is packaged in a form having a desired shape, which is then placed in a desired location, and water is added to the mixture, ultimately resulting in a hardened concrete structure. Additionally, a modular concrete form may be used to form desired shapes for the concrete structures.

Concrete (which may be used interchangeably herein with the term cement) is used for creating concrete structures such as paved surfaces, patio slabs, sidewalks, curbs, bases for fence posts and mailboxes, and the like. Concrete slurry is poured into the void or inner cavity created by concrete forms, which may be either permanent or temporary. Permanent forms remain attached to the solidified concrete with the exterior surface of the permanent form creating an edge surface. Temporary forms, in contrast, are removed after the concrete solidifies to reveal a concrete edge. For most home or do-it-yourself jobs, temporary forms are used. For instance, if a person wishes to install a concrete patio at their home, the person would first construct a concrete form, usually out of wood, which is shaped as desired and used to hold the wet concrete in place temporarily until the concrete hardens. Then, the concrete form is removed and discarded. The preparation of the form is a time consuming and expensive process.

Therefore, it would be desirable to provide a system where a dry concrete mixture is packaged in a container having a desired shape, such as a square or rectangular slab, and where the packaging itself serves as the concrete form. In this way, the consumer purchases the dry concrete mixture in the preformed packaging, places the item in the desired location, and simply adds water to the concrete mixture. Then, after the concrete is allowed to dry, the packaging may be cut or peeled away from the concrete structure, thereby obviating the steps of building the form and then removing it after drying.

It would also be desirable to provide an alternate embodiment, whereby a modular concrete form is provided so that a user could assemble various components of a form assembly into a desired shape.

SUMMARY OF THE INVENTION

The present invention includes, in a first embodiment, a concrete structure kit comprising a dry powdered concrete mixture contained within a shaped container or packaging. In use, the packaged concrete mixture is placed in a desired location, water is added to the dry mixture in an appropriate amount, and the concrete is allowed to set in the shape of the packaging. After the concrete has hardened, the packaging may be removed from the outside of the concrete structure. Although prefabricated concrete structures are commercially available, this system has several advantages. One advantage is that the shaped container with a dry powdered cement mixture weighs much less than a corresponding prefabricated concrete structure, thus making transport easier. Additionally, a prefabricated concrete structure may be broken or damaged during transport, while the shaped packaging and dry powdered cement unit is unlikely to be similarly affected.

In a second embodiment, a modular concrete mold system is provided, which includes a series of interlocking pieces having various shapes, such as straight sides, curved sides, corners, acute and obtuse angles, and the like. This system allows a user to construct a concrete form by attaching the shaped components of the modular system, resulting in a concrete form that has a specific, creative, desired shape.

The present invention also includes methods associated with the concrete form systems provided herein.

BRIEF DESCRIPTION OF THE DRAWINGS

These and other features, aspects, and advantages of the present invention will become better understood with regard to the following description, appended claims, and accompanying drawings where:

FIG. 1 is a perspective view of one embodiment of a shaped container filled with a dry concrete powder mixture;

FIG. 2 is a perspective view of another embodiment of a shaped container, in this case a cylindrical base for a mailbox post;

FIG. 3 is an exploded view of a modular concrete form; and

FIG. 4 is a perspective view of a modular concrete form.

DETAILED DESCRIPTION OF THE INVENTION

A first embodiment of the concrete form system 2 is shown in FIG. 1. A dry powdered mixture of concrete 4 is contained within a disposable shaped outer shell, container or packaging 6. A filter 8 may optionally be positioned over a top surface of the concrete mixture, which allows water to pass through, but which prevents the concrete mixture 4 from falling out of the container 6. It is not necessary for the filter 8 to be connected to the container, and may simply be placed over the concrete mixture. In this embodiment, the container 6 is placed in a desired location, and then water is added in sufficient quantity to form a slurry within the shaped container 6. Then, the concrete slurry is allowed to set. After the concrete has sufficiently hardened, the container 6 may be cut away or otherwise removed from the concrete structure. The dry powdered concrete mixture 4 may be sold within the shaped container 6 (optionally but preferably including the filter 8 as set forth above) as a kit, which is then used by the consumer to form the final concrete structure. Additionally, the kit may be placed into a plastic, or preferably a polyethylene bag, for storage, shipping and sales, in order to protect the kit from being exposed to water.

FIG. 2 shows one example of an application of the concrete form system 2. FIG. 2 illustrates a cylindrical shaped container 6 holding a dry powdered mixture of concrete 4. In its final hardened form, the concrete structure shown in FIG. 2 is a base for a mailbox. A removable dowel 10 (or other article having a desired shape to maintain a hole in the dry concrete powder for a post having a round, square, or other shaped cross-section) is positioned axially within the dry powdered concrete mixture 4, and is used to maintain a hole therein for the ultimate positioning of the mailbox post within the concrete structure. The dowel 10 or other article may be solid, or may be hollow, depending upon the ultimate use envisioned, and may be made from any suitable material, including cardboard. A filter layer or perforated sheet 8, which may be made from any suitable fabric or perforated paper, is disposed across the top of the dry concrete powder 4. It is contemplated that a user could purchase the unit shown in FIG. 2. Then, the user would dig a hole in the desired place where he or she would like the mailbox to be located. The container 6 would then be placed into the hole, and the removable dowel 10 is removed. In one embodiment, a hollow, cardboard dowel may be used so that a mailbox post (or any other article) may be inserted through the hollow dowel within the concrete mixture, and then the cardboard dowel may be removed from the concrete mixture and ripped or cut open to remove it from the post, in order to allow the concrete mixture to adhere to the post. Water is then added to the powdered concrete mixture 4 by pouring or spraying the water preferably through the filter layer 8 (or directly onto the dry powdered concrete mixture 4 if no filter layer 8 is present), thus creating the concrete slurry. The concrete is allowed to set and harden, and then the filter layer 8 (if applicable) and the container 6 may be removed or cut away from the concrete structure.

One purpose of the perforated sheet or filter 8 may be to act as a dispensing mechanism to apply certain chemical admixtures as needed to the unit by first saturating the perforated sheet with chemical admixture such as a water reducing agent or sealant, accelerant or color dye as desired for decorative purposes. The benefits of admixtures may vary depending on the user to alter the properties of concrete and make it more suitable for certain usage. These benefits may apply to both the finish and unfinished stage of the concrete laying process and in certain instances may be required to increase the quality of the concrete.

For instance, an exemplary chemical additive may be a water reducing agent manufactured by EUCLID Chemicals that reduces the amount of water needed to gain workability by giving the concrete consistency while simultaneously slowing the setting time which is advantageous to inexperience DIYers that require more time than professionals to finish concrete. The use of water reducers and retarders can be combined together in one chemical or manufactured separately but still can be saturated in the perforated sheet and dispensed into mix as needed. Other admixtures, for example those manufactured by W. R GRACE may be used as an accelerant and decreases the setting time required which is advantageous for users in extremely cold regions where product may be sold while providing early strength. The use of chemicals admixtures such as dyes to provide color for decorative purposes can also be saturated within and dispensed by the perforated sheet.

The chemical additives listed above, as well as any other suitable or desirable ones, may be added to the perforated sheet 8 in any suitable manner. One method of saturating the perforated sheet 8 is to simply soak the sheet in the liquid chemical mixture for a period of time, and then to remove the perforated sheet 8 from the liquid chemical mixture and allow the perforated sheet 8 to dry with the saturated chemicals imbedded therein. Then, the dry saturated perforated sheet 8 is added to the packaging containing the concrete. In use, when a user is ready to add water, the water is poured over the perforated sheet 8 so that it soaks through the perforated sheet and passes therethrough to form the slurry. As the water passes through the perforated sheet 8, the chemical mixture that is embedded in the perforated sheet is dissolved within the water and seeps into the slurry. In this way, the perforated sheet 8 is used as a means for delivering any appropriate chemicals, such as the above-mentioned accelerants or sealants, to the slurry during the step where water is added to the concrete mixture.

The shaped container 6 may be made from any suitable material including cardboard or plastic, and may be formed into any desired shape. The dry concrete powder mixture 4 may include other ingredients and aggregates, including fly ash, silica fume, calcinated shale or clay, natural sand, manufactured sand, gravel, light weight aggregates, air entrained additives and blast furnace slag. Any suitable dry concrete powder mixture 4 may be used. Additionally, colors, patterns, or other decorative features may be included, as well, using any known and commercially available colorants, pigments, dyes or techniques.

In a second embodiment illustrated in FIGS. 3 and 4, a modular concrete form 20 system is provided, which includes a series of interlocking pieces 22, 24 having various shapes, such as straight sides 22, curved sides, corners 24, acute and obtuse angles, and the like. This system allows a user to construct a concrete form by attaching the shaped components of the modular system 20, resulting in a concrete form that has a specific, creative, desired shape. After the form 20 is constructed, it is placed in a desired location, and then the dry powdered concrete mixture is added to the inside of the form. Water is then added in order to create the slurry. Alternatively, slurry may be added directly to the form 20, rather than mixing the dry concrete powder mixture with the water within the form 20. The concrete slurry is then allowed to set, and when the concrete structure is sufficiently hardened, the modular concrete form 20 may be removed and disassembled. The modular concrete form system may be reused repeatedly. The modular components 22, 24 may be manufactured from any suitable material, although polystyrene is preferred.

Although the present invention has been described in considerable detail with reference to certain preferred versions thereof, other versions are possible. Therefore, the spirit and scope of the appended claims should not be limited to the description of the preferred versions contained herein. All features disclosed in this specification may be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. A kit for forming a concrete structure, said kit comprising: a shaped container having a dry concrete powder mixture packaged therein in an amount sufficient to form said concrete structure; said shaped container including a fluid impermeable bottom portion of a predetermined shape that corresponds with the shape of a concrete structure to be produced and a fluid permeable cover affixed to said fluid impermeable bottom portion; said fluid permeable cover allowing water to be added to said dry concrete powder mixture in said container to form a slurry within said shaped container upon the addition of the water whereby the concrete structure hardens and forms therein; whereby said concrete structure is produced within said shaped container, which may be removed from said concrete structure upon hardening; wherein said fluid permeable covering includes a chemical additive selected from the group consisting of a dye, an accelerant or a water reducing agent, so that when water passes therethrough, the chemical additive dissolves in water and becomes mixed with said slurry.

2. The kit set forth in claim 1 wherein said fluid permeable covering includes a filter layer made from a material that filters and allows water to freely pass therethrough.

3. The kit set forth in claim 2 wherein said filter layer is selected from the group consisting of perforated paper or fabric.

4. The kit set forth in claim 1, wherein said container has a generally cylindrical shape, and which includes an article positioned axially within said dry concrete powder mixture for preserving a hole into which a post may be received.

* * * * *